US011312537B1

(12) United States Patent
Myers et al.

(10) Patent No.: US 11,312,537 B1
(45) Date of Patent: Apr. 26, 2022

(54) PACKAGING FOR RETAINING ARTICLES TO BE PERSONALIZED

(71) Applicant: CreateMe Technologies LLC, New York, NY (US)

(72) Inventors: Thomas C. K. Myers, San Francisco, CA (US); David Wayne Blizzard, San Francisco, CA (US)

(73) Assignee: CreateMe Technologies LLC, New York, NY (US)

( * ) Notice: Subject to any disclaimer, the term of this patent is extended or adjusted under 35 U.S.C. 154(b) by 0 days.

(21) Appl. No.: 17/364,654

(22) Filed: Jun. 30, 2021

(51) Int. Cl.

| | |
|---|---|
| ***B65D 25/10*** | (2006.01) |
| ***B65D 25/54*** | (2006.01) |
| ***B65D 85/18*** | (2006.01) |
| ***A45C 11/04*** | (2006.01) |
| ***A45C 11/00*** | (2006.01) |
| *G09F 23/00* | (2006.01) |

(52) U.S. Cl.
CPC ..... *B65D 25/103* (2013.01); *A45C 11/04* (2013.01); *B65D 25/54* (2013.01); *B65D 85/187* (2013.01); *A45C 2011/003* (2013.01); *G09F 23/00* (2013.01)

(58) Field of Classification Search
CPC ... A45C 11/04; A45C 2011/003; B65D 25/10; B65D 25/103; B65D 25/54; B65D 85/187; G02C 5/02; G02C 11/02; G09F 23/00; A44C 25/00
USPC ..... 206/5, 6
See application file for complete search history.

(56) References Cited

U.S. PATENT DOCUMENTS

| | | | | |
|---|---|---|---|---|
| 1,952,071 | A * | 3/1934 | Hunter | B65D 5/5059 206/5 |
| 6,948,808 | B1 * | 9/2005 | Callahan | G02C 11/02 351/41 |
| 7,490,717 | B2 * | 2/2009 | Chao | A47F 7/021 206/6 |
| 2013/0335694 | A1 * | 12/2013 | Huang | G02C 7/021 351/51 |
| 2015/0049293 | A1 * | 2/2015 | Hodgson | G02C 11/02 351/52 |
| 2015/0331261 | A1 * | 11/2015 | Mikolajczak | C09J 5/00 156/249 |

FOREIGN PATENT DOCUMENTS

| | | | |
|---|---|---|---|
| CN | 201828731 | U * | 5/2011 |
| CN | 202083850 | U * | 12/2011 |

* cited by examiner

*Primary Examiner* — Bryon P Gehman
(74) *Attorney, Agent, or Firm* — Kilpatrick Townsend & Stockton LLP

(57) ABSTRACT

Packaging for retaining an article to be personalized in a predetermined position relative to the packaging may include a first container defining an interior cavity and an insert designed to retain the article in a predetermined position and orientation relative to the insert. The insert may be positioned within the interior cavity so that the article retained by the insert is within the interior cavity. At least one of the first container may define an opening designed to provide access to a personalization system for personalizing a predetermined surface of the article while the article is retained by the insert and the insert and article are positioned within the interior cavity so that the predetermined surface can be personalized based on the position of the first container relative to the personalization system.

5 Claims, 17 Drawing Sheets

PACKAGING FOR RETAINING ARTICLES TO BE PERSONALIZED

FIELD OF THE INVENTION

The present technology relates to the fields of packaging of articles, and more specifically to packaging of personalized articles, for example, clothing items.

BACKGROUND

Personalization of garments and accessories is becoming more popular through various personalization systems, including, but not limited to, embroidery systems, direct to garment (DTG) printing systems, engraving systems, laser etching/cutting systems, robotic pen marking and sticker/decal application systems. Personalization of articles is currently a labor-intensive process that requires precision positioning and orienting of articles relative to a personalization system. Due to different shapes and sizes of articles, personalization of multiple articles may require each article to be positioned and oriented differently when being loaded onto a personalization system, otherwise the location of the personalization may be performed on the desired surface.

Accordingly, there is a need for a means for articles to be personalized while reducing or eliminating the skill labor and time required to load a personalization system in order for the personalization to be performed precisely on the desired surface.

BRIEF SUMMARY

Packaging for retaining an article to be personalized in a predetermined position relative to the packaging may include a first container defining an interior cavity and an insert designed to retain the article in a predetermined position and orientation relative to the insert. The insert may be positioned within the interior cavity so that the article retained by the insert is within the interior cavity. At least one of the first container may define an opening designed to provide access to a personalization system for personalizing a predetermined surface of the article while the article is retained by the insert and the insert and article are positioned within the interior cavity so that the predetermined surface can be personalized based on the position of the first container relative to the personalization system.

In some embodiments, the personalization system may be one of an embroidery system, a direct to garment (DTG) printing system, an engraving system, a laser etching/cutting system, a robotic pen marking or a sticker/decal application system. The opening may be designed to receive a personalization head of the personalization system. In some embodiments, the article includes a substantially rigid portion, and the insert is designed to contact the substantially rigid portion in order to retain the article in the predetermined position and orientation. The article may be a pair of eyeglasses and the substantially rigid portion of the article may include a lens frames or arms of the eyeglasses. The insert may define an opening designed to receive the arms of the eyeglasses in order to retain the eyeglasses in the predetermined position. In some embodiments, the insert includes a plurality of protrusions composed of resilient material, and the plurality of protrusions may be designed to exert a clamping force on the lens frame of the eyeglasses in order to retain the eyeglasses in the predetermined position. In some embodiments, the predetermined surface is a surface of the arms of the eyeglasses. In some embodiments, the predetermined surface is a surface of the lens frame of the eyeglasses. In some embodiments, the insert is designed to retain the eyeglasses in a disassembled configuration with the arms uncoupled from the lens frame, and the insert may also be designed to retain two arms of the eyeglasses so that outer side surfaces of the two arms are substantially planar. In some embodiments, the insert is designed to retain the lens frame between the insert and the first container within the interior cavity.

In some embodiments, the article is a pair of shoes and the substantially rigid portion of the article comprises soles of each shoe of the pair of shoes. The insert may define cutouts designed to retain the soles of each shoe of the pair of shoes so that bottom surfaces of the soles are coplanar. The first container may define a first opening designed to provide access to the personalization system for personalizing a predetermined left outside surface of a left shoe of the pair of shoes, and define a second opening designed to provide access to the personalization system for personalizing a predetermined right outside surface of a right shoe of the pair of shoes. The cutouts may be designed to retain the soles of each shoe of the pair of shoes with a press-fit. In some embodiments, the first container comprises a lid flap configured to transition between an open position and a closed position. The packaging may further comprise a secondary insert coupled to the lid flap. Transitioning the lid flap from the open position to the closed position may cause the second insert to be positioned within top openings of each shoe of the pair of shoes in order to maintain the pair of shoes in the predetermined position and orientation. The secondary insert may include two elongated protrusions designed to be received within top openings of each shoe and a handle portion between and coupled to the two elongated protrusions. The insert may define cutouts designed to retain side profiles of each shoe of the pair of shoes so that bottom surfaces of the soles are facing away from each other, and the first container may define the opening and the opening is designed to provide access to the personalization system for personalizing a predetermined left outside surface of a left shoe of the pair of shoes a predetermined right outside surface of a right shoe of the pair of shoes.

In some embodiments, the article is an electronic tablet and the substantially rigid portion of the article comprises a casing of the electronic tablet. The insert may be formed of a single sheet of folded material. The folded material may define a recess designed to receive the electronic tablet and tabs configured to contact the predetermined surface and retain the electronic tablet in the recess. The insert may be designed to retain a second article. The second article may be a second electronic tablet, smaller than the electronic tablet, and the insert may include a first side defining a first recess designed to retain the electronic tablet, and the insert may include a second side, opposite the first side defining a second recess, smaller than the first recess, and designed to retain the second electronic tablet.

In some embodiments, the article is a pair of folded pants, and the insert is designed to contact the folded pants on at least three sides. The pair of folded pants may include two rear pockets and the insert may define a first opening designed to provide access to the personalization system for personalizing a predetermined surface of a left pocket of the two rear pockets, and define a second opening designed to provide access to the personalization system for personalizing a predetermined surface of a right pocket of the two rear pockets.

BRIEF DESCRIPTION OF THE SEVERAL VIEWS OF THE DRAWINGS

The disclosure will be readily understood by the following detailed description in conjunction with the accompanying drawings, wherein like reference numerals designate like structural elements, and in which.

DETAILED DESCRIPTION

Figure 1A:
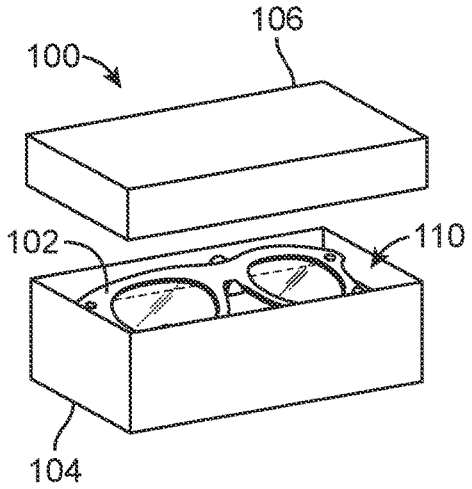
FIGS. 1A-1H show packaging for retaining eyeglasses to be personalized according to embodiments of the present technology.

Aspects of the present technology relate generally to packaging for articles to be personalized, and more particularly to packaging for securely retaining an article in a predetermined position and orientation relative to the packaging so that a predetermined surface of the article is accessible through an opening in the packaging by a personalization system.

In the following description, various examples of packaging are described. For purposes of explanation, specific configurations and details are set forth in order to provide a thorough understanding of the embodiments. However, it will be apparent to one skilled in the art that certain embodiments may be practiced or implemented without every detail disclosed. Furthermore, well-known features may be omitted or simplified in order to prevent any obfuscation of the novel features described herein.

The following high-level summary is intended to provide a basic understanding of some of the novel innovations depicted in the figures and presented in the corresponding descriptions provided below. Many of the embodiments relate to packaging that may be used to retain variously sized and shaped articles for personalization.

The embodiments of packaging as disclosed herein, for example retail packaging, may for used to retain an article to be personalized. The packaging may be used for storage, transport, personalization, and retail of the article. The packaging may include a plurality of components for retaining the article within the packaging in a predetermined position and orientation. One or more components of the packaging may include openings, also referred to as personalization openings, providing access for a personalization system to personalize a predetermined surface of the article within the packaging. In some embodiments, the packaging may include components for covering the personalization opening during times when the article is not in the process of being personalized. The components for covering the personalization opening may include, but are not limited to, doors, flaps, lids, and sleeves. The components for covering the personalization opening may provide protection to the article, for example protection from outside contaminants including dust and moisture. The components for covering the personalization opening may be transparent so that the predetermined surface of the article is visible before and/or after personalization when the opening is covered. The retention of the article and corresponding opening are beneficial in allowing the article to be personalized without being removed from the packaging. Not removing the article from the packaging is beneficial in reducing or eliminating labor costs, time, and skill at the point of personalization. Further, personalizing an article without removing the article from the packaging is beneficial in allowing the same packaging, or portions thereof to be used for storage, transport, personalization and retail.

In some embodiments, the packaging may allow one or more users to place an article in the packaging in a predetermined position and orientation. As used herein, the term "user" may refer to one or more humans being classified as one or more of: a skilled machine operator, an unskilled machine operator, a retail store clerk, and/or a retail customer. Due to the features of the packaging, the article may only be positionable and retained in the packaging in a limited number of positions and orientations, for example exactly one position and orientation. Accordingly, a user with no previous skill or knowledge of the packaging may be able to place the various articles into the various packaging in the predetermined positions and orientations. Multiple packaging with the articles retained within may be loaded onto a personalization system without the user precisely positioning and orienting the article.

More specifically, in some embodiments, packaging includes a first container and an insert. The first container may define an interior cavity. For example, the first container may be a box, or a portion thereof. The insert may include features for retaining an article to be personalized in a predetermined position and orientation relative to the package, and therefore relative to the personalization opening(s). The predetermined position of the article relative to the insert may be defined by contact of a first plurality of points of the article with a second plurality of points of the insert. The predetermined position of the article relative to the insert may be one of a limited number, including the only, position and orientation wherein all of the first plurality of points of the article each contact a portion of the insert, and/or the only position and orientation wherein all of the second plurality of points of the insert each contact any portions of the article. In other words, the article may not be able to be slightly misaligned when placing the article into the insert for secure retention. This is beneficial in allowing the article to be retained by the insert without using precise manipulation and skill to correctly position and orient. In other words, in some embodiments there is only one orientation wherein the article is retained by the insert and all other positions and orientations of the article relative to the insert do not result in retention.

With the article is in the predetermined position relative to the insert, the article may be retained in a plurality of degrees of freedom. In some embodiments, the insert may be retained in four degrees of freedom, for example retained in two orthogonal degrees of translational freedom, and two orthogonal degrees of rotational freedom. In other words, the article may be removed from the insert, i.e. no longer retained, by translating the article away from the insert in a direction orthogonal to the two directions of translational retention, or by rotating the article away from the insert around an axis orthogonal to the two axes of rotational retention, With the packaging oriented so that gravity retains the article against the insert in the direction that the insert does not directly retain the article through engagement, the packing may be positioned within a personalization system with the article maintained in the predetermined position. In some embodiments, the insert may be retained in five degrees of freedom, or all six degrees of freedom, relative to the other components of the packaging, both of which allow additional degrees of manipulation of the packaging relative to a personalization system while maintaining the predetermined position of the article relative to the insert, and therefore relative to the first container. In some embodiments, one or more inserts, or parts thereof, for retaining the article may be separately and/or integrally formed with other components of the packaging. This retention of the article by the insert, and therefore the packaging as a whole, is beneficial in allowing an unskilled operator or a robot to position packaging retaining an article within a personalization system using only the outer container of the packaging. For example, a personalization system may include a corner recess for receiving a corner of a box, and with a corner of the first container positioned in the corner, the article is positioned in a predetermined position and orientation relative to the personalization system, and therefore the personalization system may precisely position and orient a personalization on a predetermined surface of the article. In some embodiments, the personalization system may include a user interface for receiving information about the packaging, for example information corresponding to the position and orientation of the predetermined surfaces relative to outer surfaces or corners of the packaging. In some embodiments, the user interface may include a read, for example a QR code reader, for reading a QR code on the packaging.

In some embodiments, the personalization system may operate to personalize predetermined surfaces of articles substantially parallel relative to an operating plane of a personalization head of the personalization system. For example, a personalization system may include a laser head for laser etching, an embroidery head for embroidery, an engraving head for engraving, or a printed head for direct to garment (DTG) printing. The personalization head may operate on a 2-dimensional plane, e.g. an XY plane, and the predetermined orientation of the article relative to a portion of the packaging supported by the personalization system, e.g. a first container, may position and orient the predetermined surface of the article to be personalized substantially parallel to the operating two-dimensional plane of the personalization head. This is beneficial in positioning articles wherein the surface opposite the surface to be personalized is not level or the article is not balanced to be able to rest on a flat surface in a position with the surface to be personalized being perpendicular to gravity. In some embodiments, the personalization system may operate to personalize predetermined surfaces of the article that are not parallel to 2-dimensional operating plane of the personalization system. In some embodiments, a personalization head may be orthogonal to the predetermined surfaces of the article to personalized. In some embodiments, a personalization head may be orthogonal to the predetermined surfaces of the article to personalized. In some embodiments, a personalization head may be orthogonal to the predetermined surfaces of the article to personalized.

The following disclosed packaging of FIGS. 1A-8I are non-limiting examples of packaging for retaining examples of articles to be personalized.

In some embodiments, packaging may include features for retaining a substantially rigid body portion of an article to be personalized. Non-limiting examples of substantially rigid body portions include portions composed of metal (e.g. a casing for electronics), plastic (e.g. eyeglass frames and arms), cardboard, or rubber (e.g. a sole of a shoe). The predetermined surface of the article to be personalized may be a surface of the substantially rigid body portion, or may be a surface of another component of the article coupled to the substantially rigid body portion, wherein the substantially rigid body portion defines at least a portion of the article to be personalized. For example, the article including a substantially rigid body portion may be, but is not limited to, a pair of eyeglasses, a pair of shoes, or an electronic tablet.

Figure 1B:
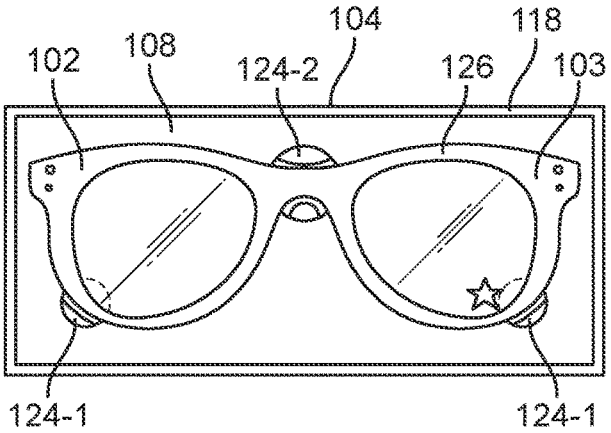

FIGS. 1A-1G show an embodiment including packaging 100, and portions therefore, for retaining a pair of eyeglasses 102 to be personalized. As shown in FIG. 1A, the packaging 100 may include a first container in the form of a bottom box portion 104 of a box. The box may further include lid portion 106 to couple to and cover the bottom box portion 104. The packaging 100 may further include an insert 108 positioned within and retained by the bottom box portion 104. In embodiments, for example as shown, the bottom box portion 104, which may also be referred to as a first container, as discussed above, defines an internal cavity 109. Further, as shown, the bottom box portion 104 may define an opening 110. The insert 108 may be inserted into the bottom box portion through the opening 110. Further, the opening 110 may provide access for a personalization system to personalize a predetermined surface of the eyeglasses 102 retained by the insert 108. As noted above, packaging may include a component for covering the personalization opening, for example the lid portion 106 covering opening 110. In some embodiments, the lid portion 106 may slide over and be designed to separate from the bottom box portion 104 and in some embodiments the lid portion 106 connected to the bottom box portion 104, for example with a hinge. The predetermined surface of the eyeglasses 102 may be one or more of one of the lens, surfaces of the frame around the lens, and/or surface of the side arms. FIG. 1B shows a top view looking into the internal cavity 109 of the bottom box portion 104 through the opening 110.

Figure 1C:
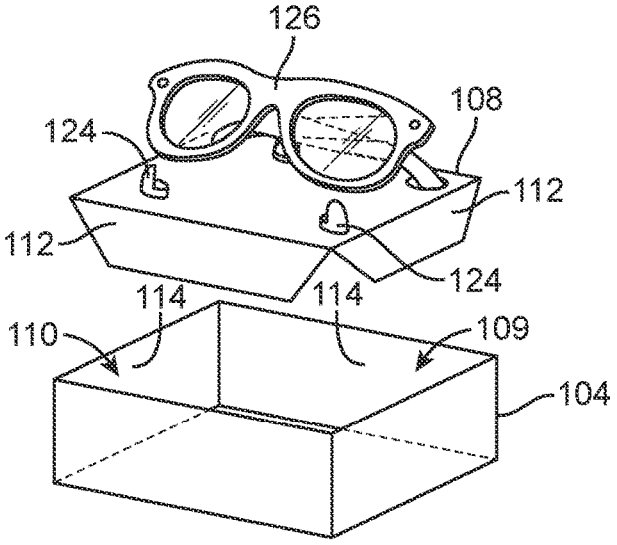

The internal cavity 109 may have a shape corresponding to the shape of the insert 108. As shown in FIG. 1C, the internal cavity 109 may be a rectangular prism and the insert 108 may be rectangular so that the sidewalls 112 of the insert 108 engage inner sidewalls 114 of the internal cavity 109 in order to prevent relative movement between the insert 108 and the bottom box portion 104. In some embodiments, for example as shown, the sidewalls 112 of the insert 108 may be shorter in height than sidewalls 114 of the internal cavity 109 so that a top surface 116 of the insert 108 is recessed from a top rim 118 of the bottom box portion 104 defining the opening 110. With the top surface 116 of the insert 108 recessed, the article 102 may be completely positioned within the internal cavity 109 as shown in FIG. 1A.

Figure 1D:
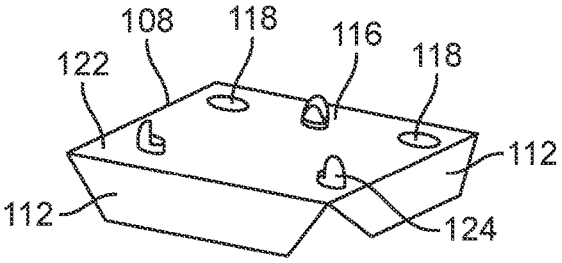

In some embodiments, an insert of packaging may define cutout portions, or include flaps, and/or protrusions for retaining an article in a predetermined position relative to the insert. For example, as shown in FIG. 1D, the insert 108 may include cutouts 118 for receiving arms 120 of the eyeglasses 102. Further as shown in FIG. 1D, the insert 108 may include a main body 122, and a plurality of protrusions 124 coupled to the main body 122.

Figure 1E:
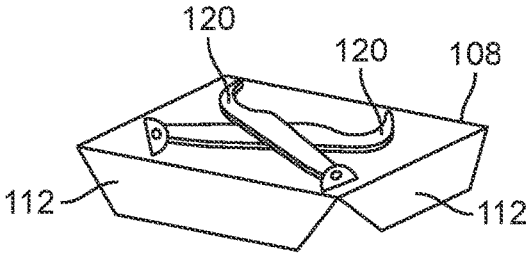

The main body 122 of the insert 108 may be formed as a cutout and then folded sheet of material, for example cardboard. In some embodiments, portions of an article may extend through cutouts of an insert in order to engage with edges of the cutouts to prevent movement of the article relative to the insert, and/or to allow portions of the article to be concealed under the insert within an internal cavity of a first container, e.g. a bottom box portion. For example, as shown in FIG. 1E, both arms 120 of the pair of eyeglasses 102 may extend through the cutouts 118 of the insert 108 so that the entirety, or substantially the entirety, of each arm 120 is positioned on an opposite side of the main body 122 as the lens frame 126 of the eyeglasses 102. In some embodiments, only a single arm 120 of the two arms of the pair of eyeglasses 102 may extend through a cutout 118 of the insert 108 so that the entirety, or substantially the entirety, of the single arm 120 is positioned on an opposite side of the main body 122 as the lens frame 126. In configuration, a predetermined surface 103 of the single arm 120 may be oriented substantially parallel with a plane of the main body 122 in order to personalize the predetermined surface of the arm. In some embodiments, a predetermined surface 103 of the single arm 120 may be oriented non-parallel with a plane of the main body 122. In some embodiments, the insert may be positioned in the bottom box portion and/or the bottom box portion may include openings in addition to opening 110 so that the side of the insert including the one or more arms is/are accessible by a personalization system. For example, the insert 108 and eyeglasses 102 in the orientation shown in FIG. 1E may be positioned in the bottom box portion 104 so that one or more arms 120 face the opening 110 and are accessible to a personalization system.

Figure 1F:
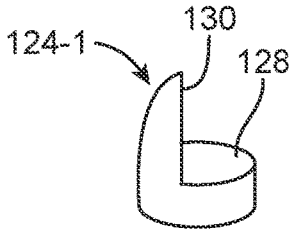
Figure 1G:
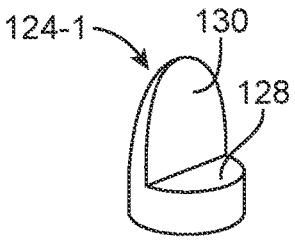
Figure 1H:
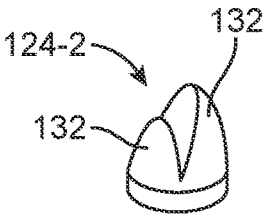

As noted above, an insert 108 may include protrusions 124. In some embodiments, the protrusions 124 may be molded and formed of a resilient material, for example rubber. FIGS. 1E and 1F show two views of a seat protrusion 124-1. Seat protrusions 124-1 include a horizontal surface 128 for supporting an article in the vertical direction, and a vertical surface 130 for retaining an article with a clamping force in the horizontal direction. FIG. 1G shows a claw protrusion 124-2 including two opposing claws 132 for supporting an article in the vertical direction, as well as providing opposing clamp surfaces to retain a portion of an article. In some embodiments, one or more inserts 108 may solely comprise one or more protrusions 124, or similar components (e.g. hooks). For example, the insert of a packaging may include a protrusion directly coupled to a bottom box portion in order to retain an article in a predetermined position and orientation within the packaging.

As shown in FIG. 1B, a claw protrusion 124-2 may retain the nose bridge of a lens frame 126 of the pair of eyeglasses 102, and two seat protrusions 124-1 may be used to vertically support a perimeter of a lens frame 126 of the eyeglasses 102. Further, the vertical surfaces 130 of the seat protrusions 124-1 may face the claw protrusion 124-2 in order for the seat 124-1 to retain the eyeglasses 102 with a clamping force opposed by the claw protrusion 124-2. In this way, the eyeglasses 102 are retained in the predetermined position relative to the insert may be defined by contact specific points on the lens frame defining a first plurality of points of the article with specific points of the protrusions defining a second plurality of points of the insert. Due to the position of the protrusions and geometry of the lens frame, the eyeglasses can only contact all of the surfaces of protrusions in a single position and orientation.

To personalize the article 102 retained in the packaging 100, a corner of the bottom box portion 104 may be positioned at a predetermined position of a personalization system, for example a complementary recessed corner. The recessed corner may act as a stop, and allow for unskilled loading of the packaging into the personalization system.

In some embodiments, an insert 108 may include any number and/or type of protrusions in order to support and retain eyeglasses 102 or any type of article with clamping force. The number, type, and position of protrusions may be based on the specific shape and size of the eyeglasses, or other type of article, to be retained.

The packaging of FIGS. 1A-1G is shown retaining a pair of eyeglasses, however as noted above, in some embodiments, packaging including cutouts and/or protrusions may be used to retain other types of articles including, but not limited to, smartphones, tablets, laptops, jewelry (e.g. watches, pendants, bracelets). For example, four or more seat protrusions may be used to contact and support a perimeter of a smartphone. Further for example, four or more seat protrusions may be used to contact and support a perimeter of a casing of a watch, with the watch band extending through cutouts.

In some embodiments, an article may be retained in packaging in a dissembled configuration in order for one or more surfaces of one or more components of the article to be substantially planar with each other which is beneficial in simultaneous or sequential personalization without reorientation of the packaging or article. For example, FIGS. 2A-2H show an embodiment of packaging 200 for retaining a pair of eyeglasses 202 in a disassembled configuration.

Figure 2A:
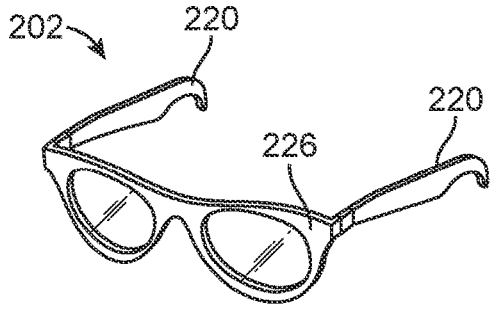
FIGS. 2A-2H show packaging for retaining eyeglasses to be personalized according to embodiments of the present technology.
Figure 2B:
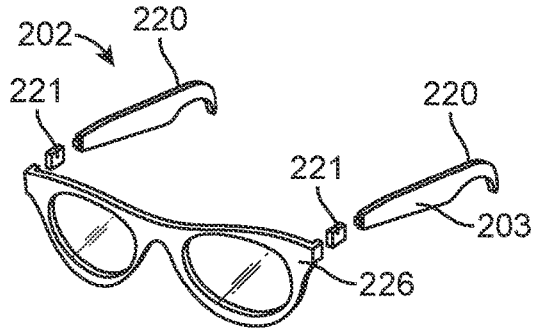

As shown in FIG. 2A, the eyeglasses 202 may be assembled with two arms 220 coupled to the lens frame 226. As shown in FIG. 2B, the arms 220 may be uncoupled from the lens frame 226 with clips 221 to place the eyeglasses 202 in a disassembled configuration. Folding the arms of eyeglasses in an assembled configuration may result in the arms overlapping and crossing, and further may result in side surfaces of the two arms being on different non-parallel planes from each other, which as discussed above may be disadvantageous for some personalization systems. Uncoupling arms of eyeglasses from a lens frames allows the arms to be retained by one or more inserts so that side surfaces of the two arms may be retained by the one or more inserts with the side surfaces on substantially parallel planes in order to be personalized.

Figure 2C:
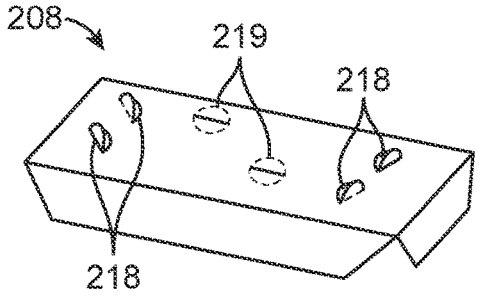
Figure 2D:
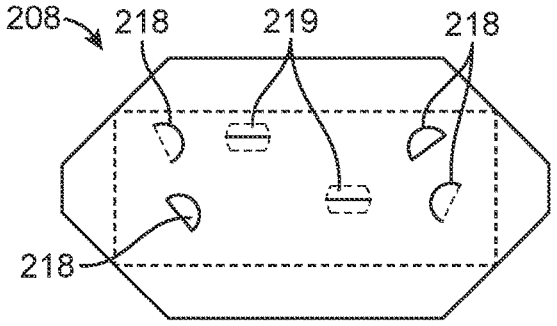
Figure 2E:
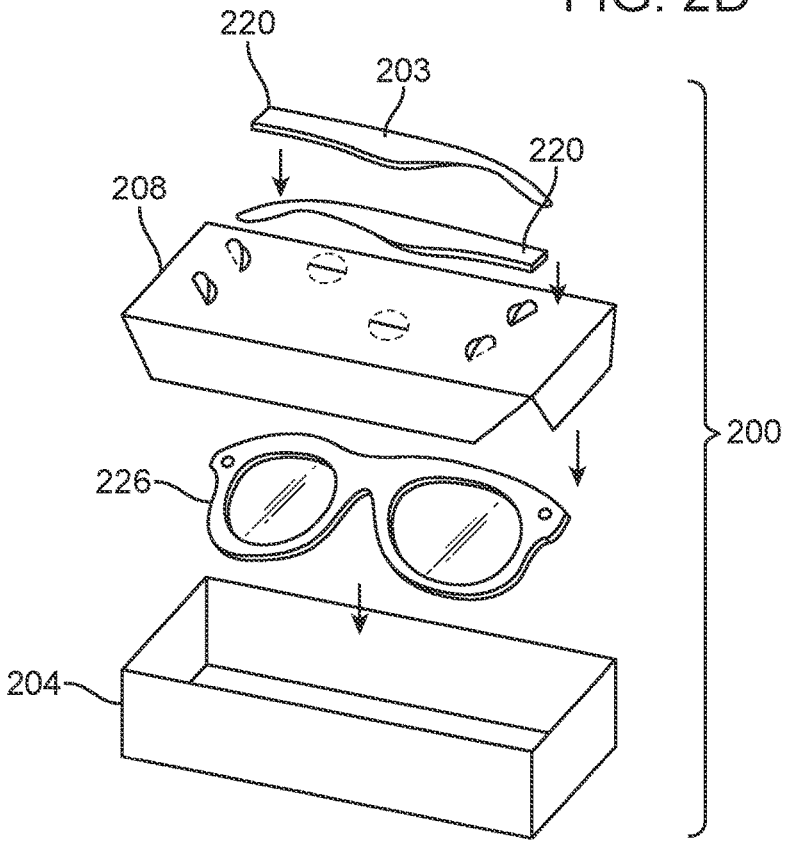
Figure 2F:
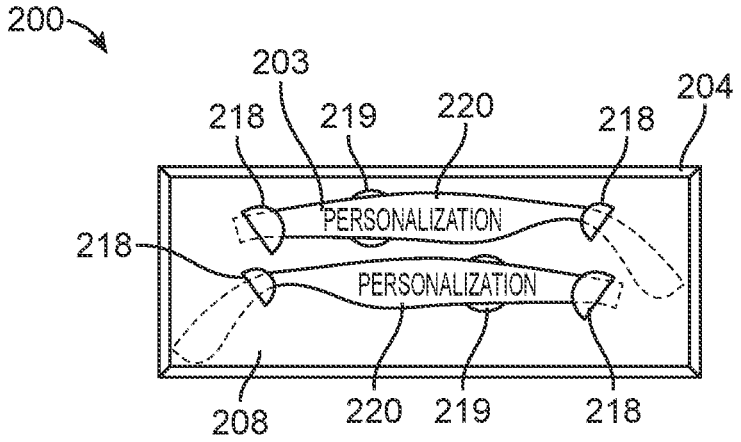
Figure 2G:
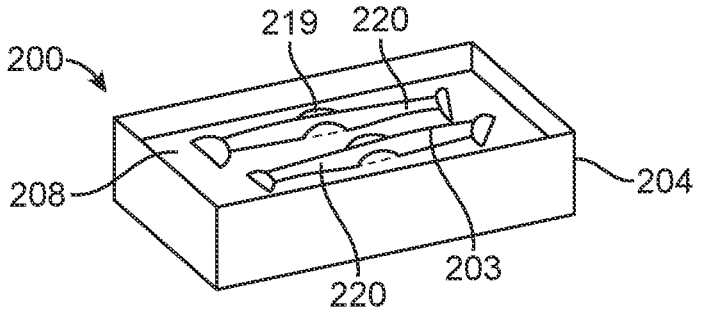

FIG. 2C shows an embodiment of the insert 208 in a folded configuration, and FIG. 2D shows the insert 208 in a flattened configuration. As noted above, an insert of a packaging may define cutout portions, and include flaps for retaining an article in a predetermined position relative to the insert. As shown in FIGS. 2C and 2D, insert 208 includes cutout portions 218 and flaps 219. The cutout portions 218 and flaps 219 may be formed by die-cutting a sheet of material forming a main body of the insert 208. As shown in FIGS. 2F and 2G, opposite ends of the arms 220 may extend through cutouts 218 of the insert 208 in order to engage with edges of the cutouts 218 to prevent movement of the arms 220 relative to the insert 208. Further, the flaps 219 may engage side edges of the arms 220 in order to further maintain the predetermined position and orientation of the article, in this example the arms 220, relative to the insert 208 and therefore the bottom box portion 204. In this way, the eyeglasses 202 are retained in the predetermined position relative to the insert may be defined by contact specific points on the arms defining a first plurality of points of the article with specific points of the cutouts and flaps defining a second plurality of points of the insert. Due to the positions of the cutouts and flaps and the geometry of the arms, the eyeglasses can only be retained by the insert in a limited number of positions and orientations.

In some embodiments, packaging may retain components of articles between an insert and the bottom box portion. For example, as shown in FIG. 2E, the lens frame 226 may be retained within the interior cavity of the bottom box portion 204 between the insert 208 and the bottom box portion 204, with the arms 220 retained within the insert 208 and positioned to be accessible from an opening of the bottom box portion 204 by a personalization system.

Figure 2H:
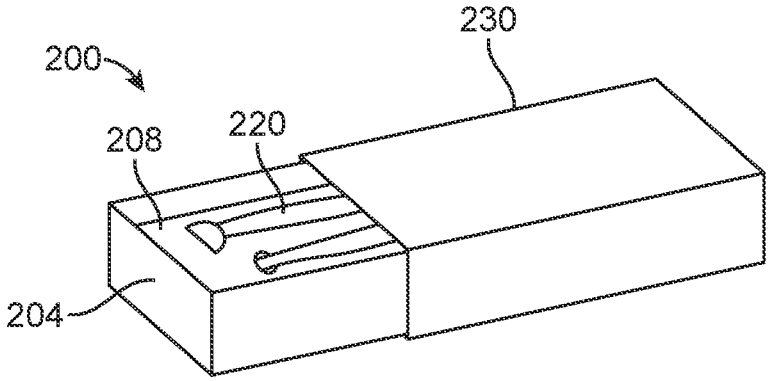

In some embodiments, packaging may include components for covering the first container during non-personalization usage, for example storage, transport and retail. For example, packaging 200 may include a sleeve 230 as shown in FIG. 2H. The sleeve 230 may slide over the bottom box portion 204 to cover the opening for personalization of the eyeglasses 202. During personalization, the bottom box portion 204 may be fully or partially removed from within the sleeve 230 in or to provide access to the article by a personalization system.

In some embodiments, packaging may include one or more inserts positioned in the first container for retaining two separate articles, for example a pair of articles. The pair of articles may be left/right mirror image articles, for example, a pair of shoes or a pair of gloves. The insert or other components of the packaging, e.g. a box portion, may include separate openings each for personalizing a predetermined surface of each of the respective articles.

Figure 3A:
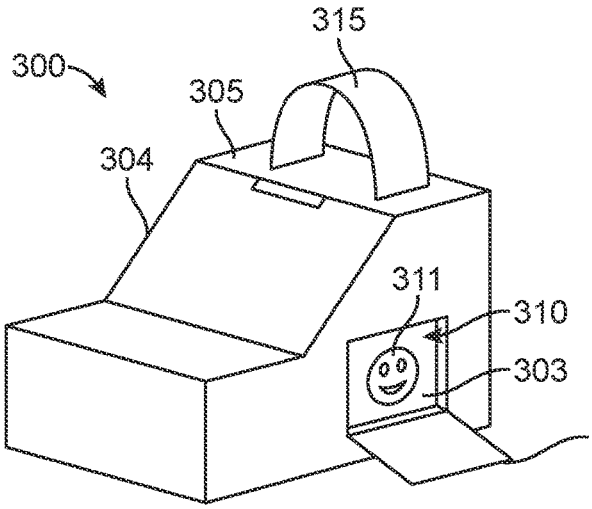
FIGS. 3A-3F show packaging for retaining a pair of shoes to be personalized according to embodiments of the present technology.

FIGS. 3A-3F, shows an embodiment of packaging 300 for retaining two separate articles to be personalized, specifically a pair of two shoes 302. The packaging 300 includes a first container in the form of an outer box 304. In some embodiments, the first container, in the example the outer box 304, may not be a rectangular prism and may have a form factor corresponding to the article(s). For example, as shown in FIG. 3A, the outer box 304 may define a form factor of two side by side high top sneakers.

Figure 3B:
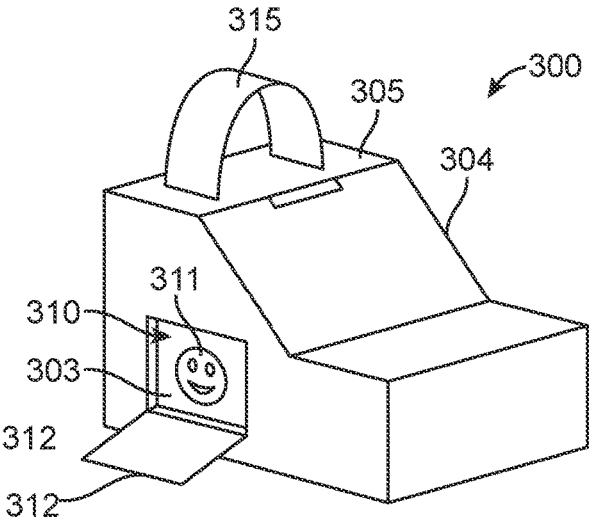

In some embodiments, packaging may include openings on opposite sides for personalizing two opposing predetermined surfaces of the same article or two surfaces of different articles, for example, as shown in FIGS. 3A and 3B the outer box 304 may include two openings 310 on opposite sides corresponding to predetermined outer side surfaces 303 of the two shoes 302. In this way, each of the shoes 302 may be symmetrically personalized, for example with a personalized image 311 on the predetermined surface 303. In some embodiments, packaging as disclosed herein, for example packaging 300, may have multiple openings for personalizing multiple different surfaces of an article. For example, the outer box 300 of FIGS. 3A and 3B may include openings over the toe panels and/or heel panels of the shoes 302. As noted above, in some embodiments, a packaging may include components for covering openings in the form of flaps or doors. For example as shown in FIGS. 3A and 3B, the packaging 300 includes doors 312 coupled to the outer box 304 for selectively covering the openings 310. The doors 312 may be held in a closed position, for example, with fasteners, snaps, adhesives, Velcro™, zippers, or magnets.

Figure 3C:
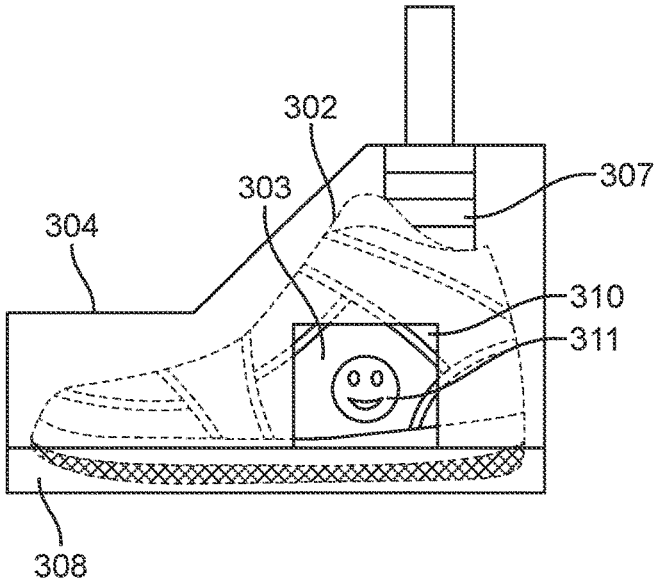
Figure 3D:
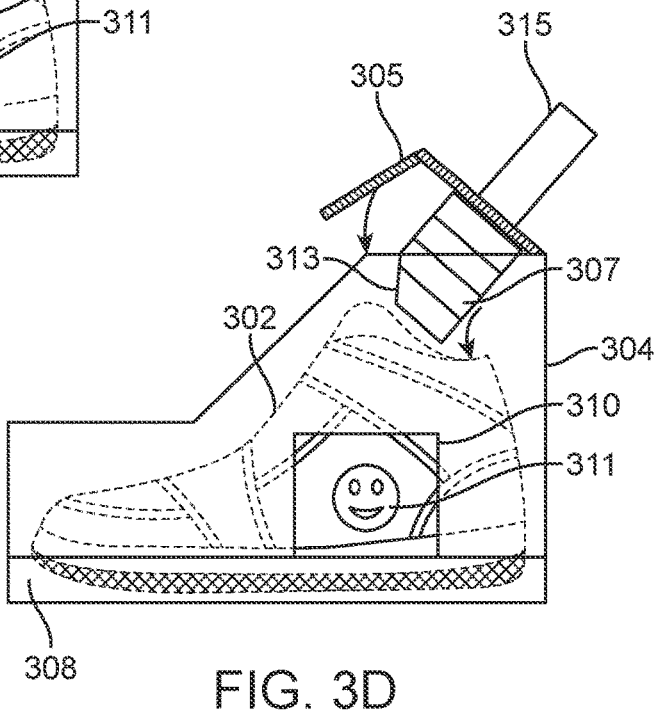
Figure 3E:
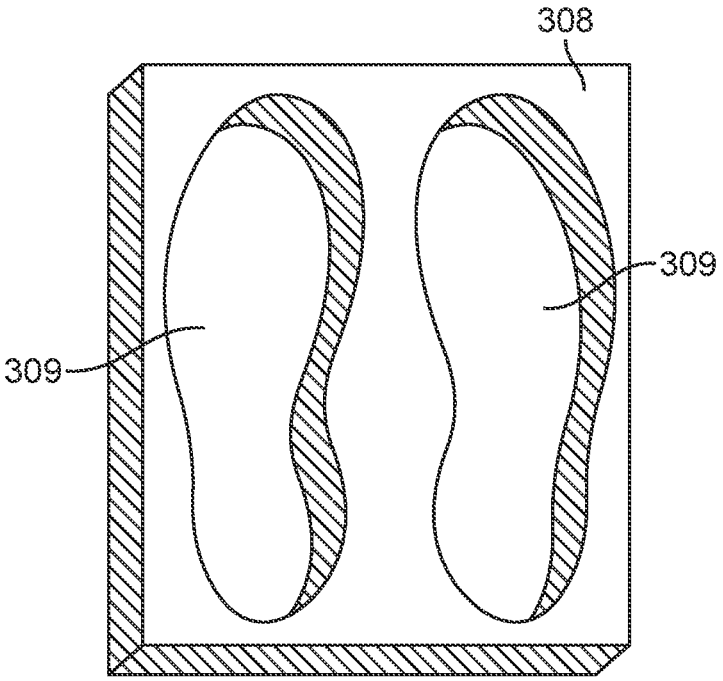

In some embodiments, articles may be retained by an insert within a recess or cutout defined by the insert. For example, shoes 302 may be retained within the outer box 304 with an insert 308 defining two cutout openings 309, as shown in FIG. 3E. The insert 308 may be shaped and sized to correspond to a bottom profile of the outer box 304, as shown in FIGS. 3C and 3D, so that the insert 308 is retained in multiple degrees of freedom in the bottom of the outer box 304. In some embodiments, the recesses/cutouts of an insert are shaped and sized to correspond to a substantially rigid portion of an article to be retained. In some embodiments, recesses and cutouts may be formed by molding and/or stacking of layers of cutout material, for example a stack of cutout cardboard.

In some embodiments of the packaging disclosed herein, the insert may be coupled to the first container, e.g. bottom box portion or outer box. Coupling may be achieved with adhesion (e.g. glue, tape) and/or mechanical fastening (e.g. staples, tabs/slots). For example, the insert 308 may be glued to the bottom of the outer box 304. Further for example, an insert and first container may define one or more sets of complementary tabs received within slots. Coupling the insert to the first container is beneficial in preventing unwanted movement of the insert relative to the first container, regardless of the orientation of the packaging. For example, during transport the packaging may be jostled or inverted while maintaining the insert, and therefore the article, in a predetermined position and orientation relative to the first container.

As noted above, FIG. 3E shows an embodiment of an insert 308 defining recessed/cutout portions 309 corresponding to substantially rigid portions of two articles, specifically, the rubber soles of each shoe 302 of a pair of shoes, i.e. the left sole and the right sole of a pair of shoes. The cutout portions 309 of an insert may be sized to have a press-fit with the article in order to prevent movement in six degrees of freedom, for example as shown, in the cross-sectional views of FIGS. 3C and 3D.

Figure 3F:
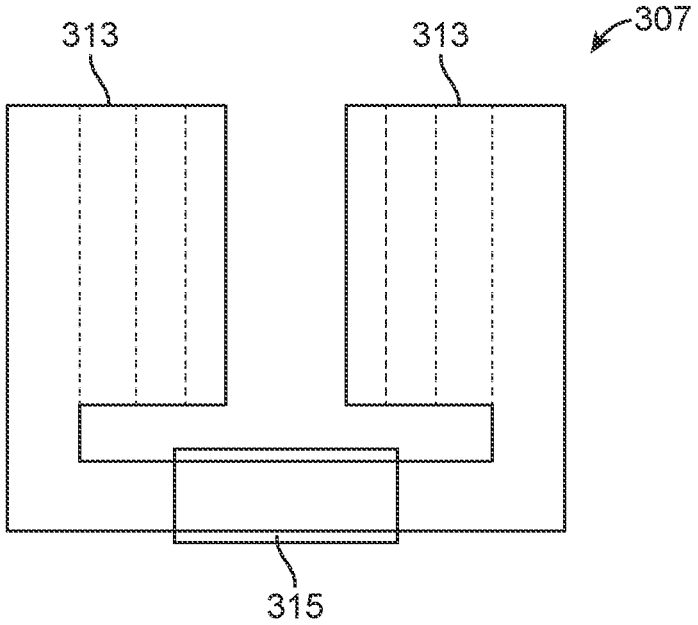

In some embodiments, packaging may include multiple inserts for engaging with different portions of an article to retain the article from multiple points. For example, as shown in FIGS. 3C and 3D, the packaging 300 may include a secondary insert 307 coupled to a lid flap 305 of the outer box 304. Transitioning the lid flap 305 from an open configuration, as shown in FIG. 3D, to a closed configuration, as shown in FIG. 3C, causes the secondary insert 307 to engage the article. Specifically, the secondary insert 307 comprises elongated protrusions 313 for inserting into the top opening of each shoe 302 of the pair of shoes. The elongated protrusions 313 provide additional support and retention to supplement the support and retention of the insert 308, in order to further maintain the article 302 in the predetermined position and orientation so that the predetermined surfaces to be personalized are maintained in the openings 310. FIG. 3F shows the secondary insert 307 in a flattened configuration. As shown the secondary insert may include a handle portion between two flattened elongated inserts. To assemble the flattened elongated inserts may be fully folded into a flattened configuration and inserted through slots in the flap lid so that the handle portion 315 is bowed, as shown in FIG. 3A. The flattened elongated inserts may then be partially unfolded to be in a tubular shape to define the elongated inserts for inserting into the top openings of the shoes. In some embodiments, the insert for a shoe, for example the secondary insert 307, may support the tongue of the shoe in order for the tongue to be retained in a predetermined position and orientation relative to the packaging in order to be personalized.

Figure 4A:
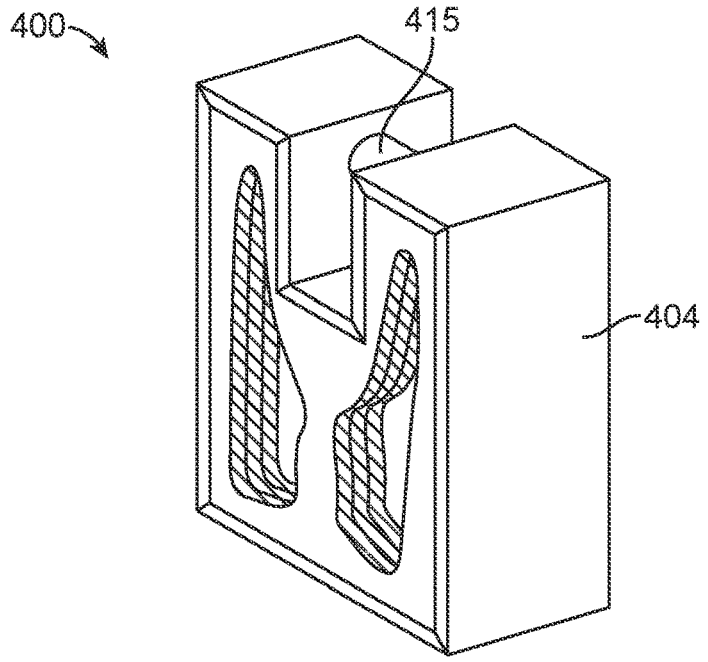
FIGS. 4A-4E show packaging for retaining a pair of shoes to be personalized according to embodiments of the present technology.
Figure 4B:
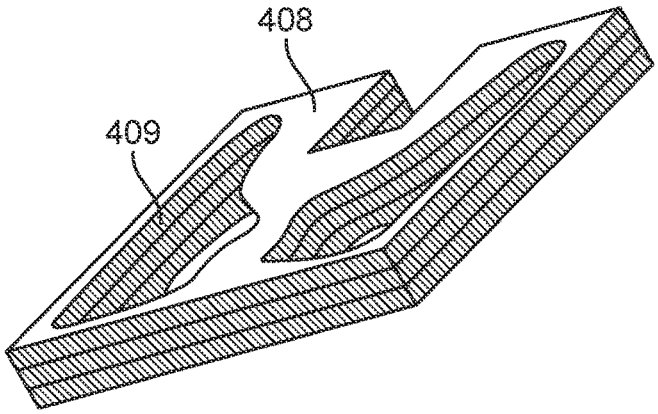
Figure 4C:
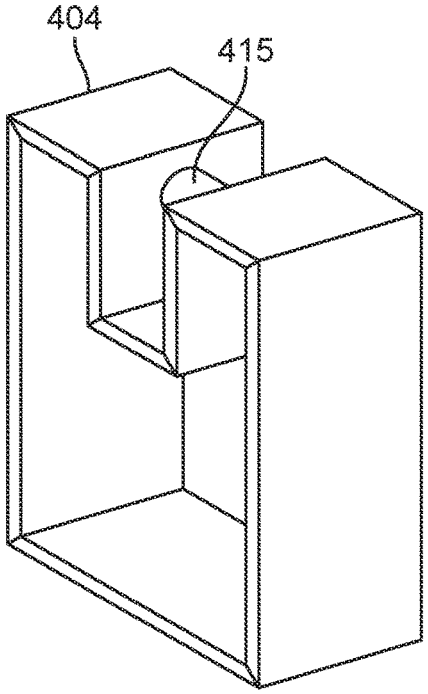

FIGS. 4A-4E show another embodiment of packaging 400 for retaining a pair of shoes 402 to be personalized. As shown in FIG. 4A-4C, the packaging 400 may include an outer box 404 and an insert 408. As shown in FIG. 4B, the insert 408 may define recessed/cutout portions similar to the insert of FIG. 3E. In some embodiments, inserts may include an outer perimeter profile with convex portions and the inner cavity of the first container may include corresponding concave portions limiting the possible orientations for positioning the insert within the outer box. As shown in FIGS. 4B and 4C, the profiles of the outer box 404 and the insert 408 may define a recess where a handle 415 of the outer box is positioned.

Figure 4D:
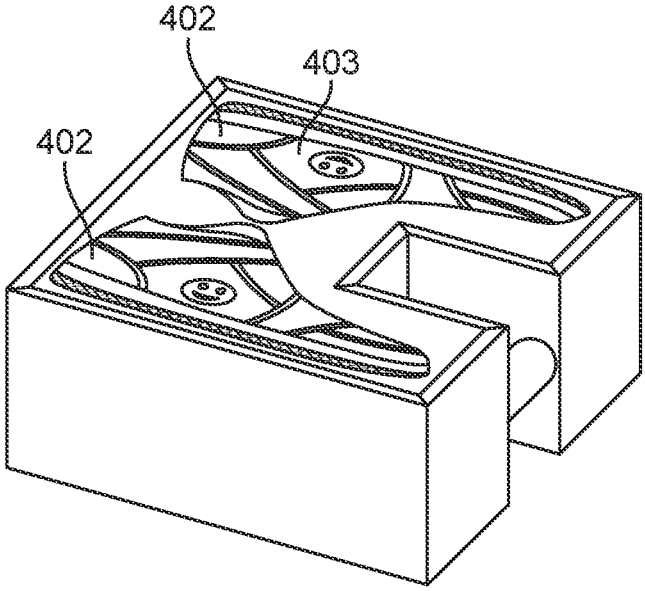
Figure 4E:
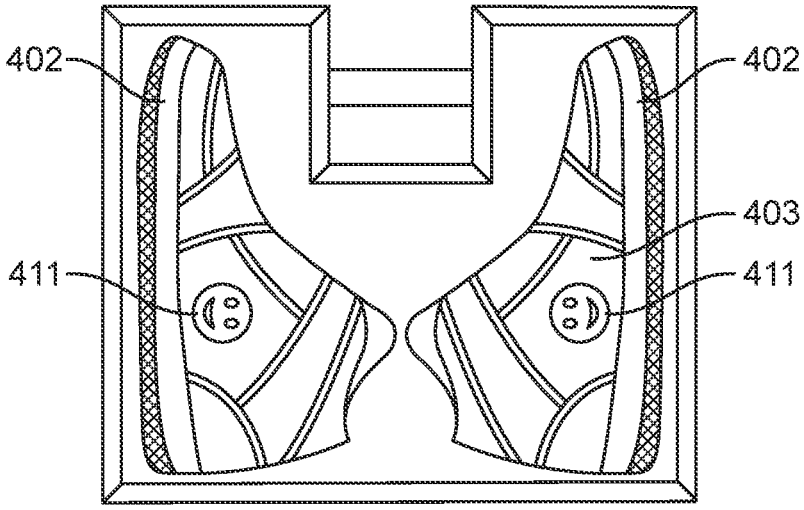

As shown in FIGS. 4D and 4E, the recessed/cutout portions of the insert 408 may be side and shaped corresponding to a side profile of each shoe 402 of the pair of shoes. In this way, the predetermined surfaces 403 of the articles to be personalized are substantially coplanar with the plane of the profile of the cutout, as opposed to substantially perpendicular to the plane of the profile of the cutout as in FIG. 3E. In some embodiments, the surfaces to be personalized may be in any orientation relative to the plane of the cutout of an insert.

In embodiments, the insert may retain an article in a position so that the article is between the insert and an outer box and may be within a volume defined by the insert. In some embodiments, the insert may define openings for providing access to the predetermined surface to be personalized by a personalization system. The openings may be sized and shaped to correspond to panels, for example textile panels, of the article to be personalized. For example, FIGS. 5A-5D show an embodiment of packaging 500 retaining a pair of pants 502, e.g. jeans.

Figure 5A:
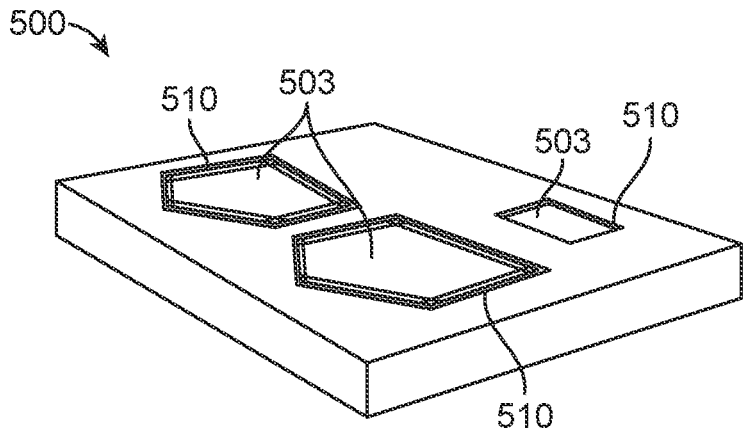
FIGS. 5A-5D show packaging for retaining a pair of pants to be personalized according to embodiments of the present technology.
Figure 5B:
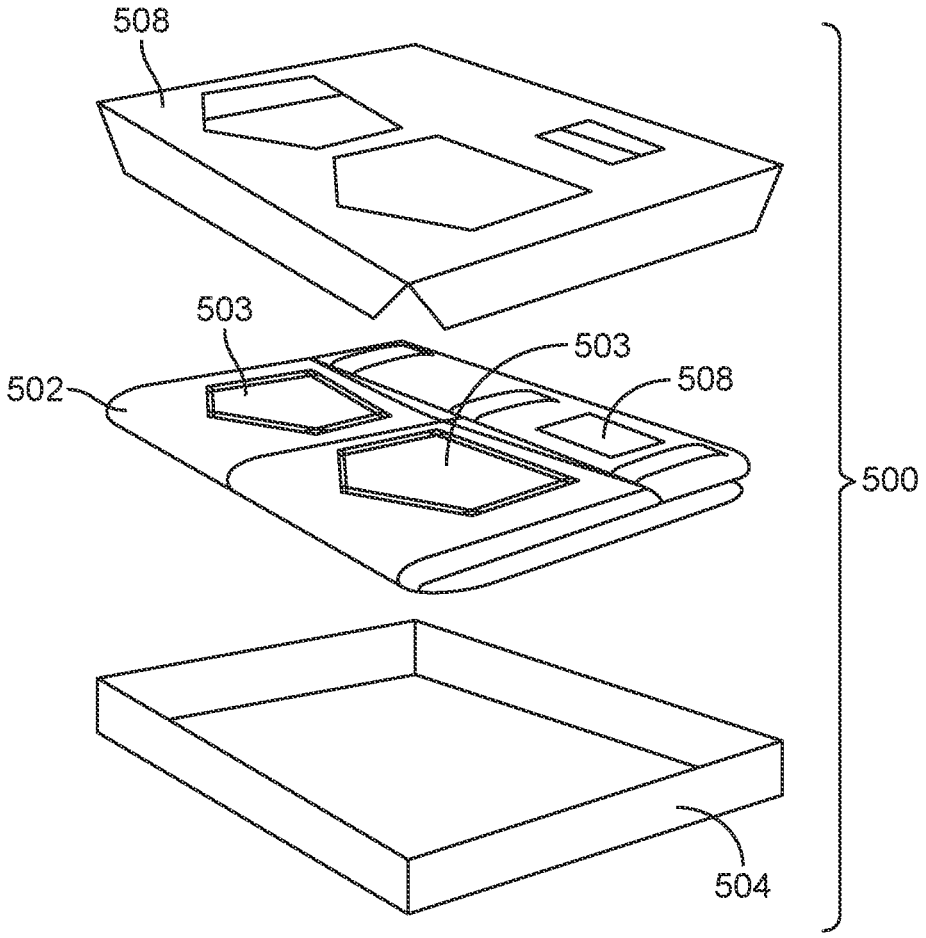

As shown in the exploded view of FIG. 5B, the packaging 500 includes an outer box 504 and an insert 508. Further, as shown the packaging 500 retains a pair of pants 502. In some embodiments, including non-rigid articles, the non-rigid articles may be folded with the surfaces to be personalized on the outside of the folded article, and further to provide additional form to the non-rigid article. For example, the pair of pants 502 may be folded into a rectangular shape with the predetermined surfaces to be personalized 503, e.g. two rear pockets and label tab, substantially on the same plane. As shown in FIG. 5A, the insert 508 may define a plurality of openings 510 corresponding to each of the surfaces to be personalized 510, i.e. two pocket cutouts and one label cutout. The insert 508 may be used to retain the pair of pants 502 within the outer box 504. In some embodiments, the packaging 500 may include an internal insert positioned within the article, for example within the folded pair of pants, in order to provided support, stiffness and stability to the article during personalization.

Figure 5C:
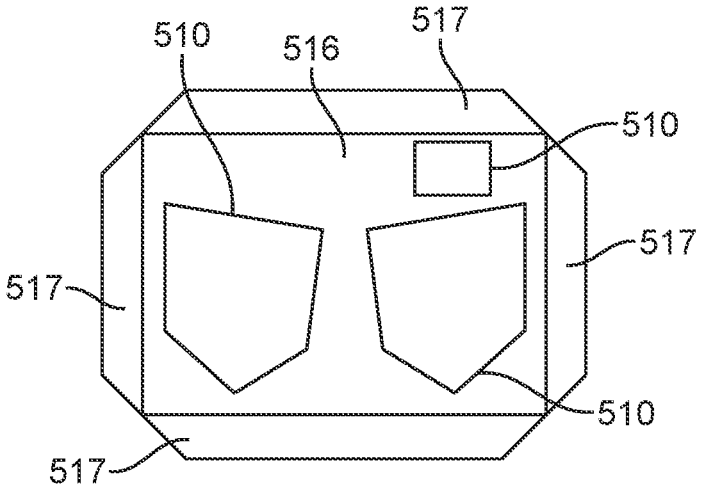
Figure 5D:
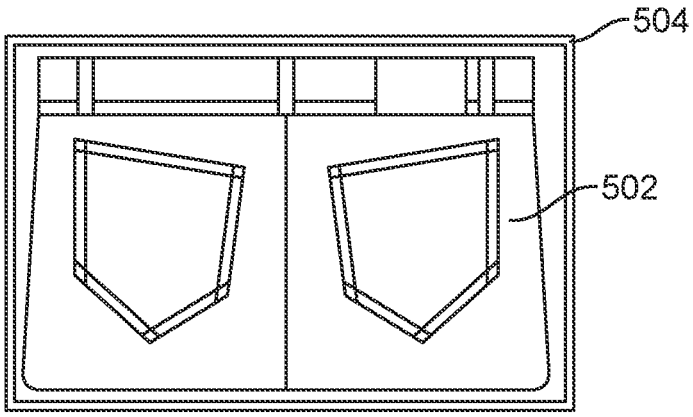

Inserts as disclosed herein may be formed by folding a sheet of die-cut material from an unfolded configuration to a folded configuration. For example, FIG. 5C shows insert 508 in a flattened configuration wherein the insert 508 include a central portion 516 and sidewalls 517. The sidewalls 517 may be folded down and inserted into gaps between the edges of the pair of pants 502 and inner sides of the outer box 504 shown in FIG. 5D, in order to define a press-fit to clamp the pants in place to prevent the pants from shifting within the outer box.

Figure 6A:
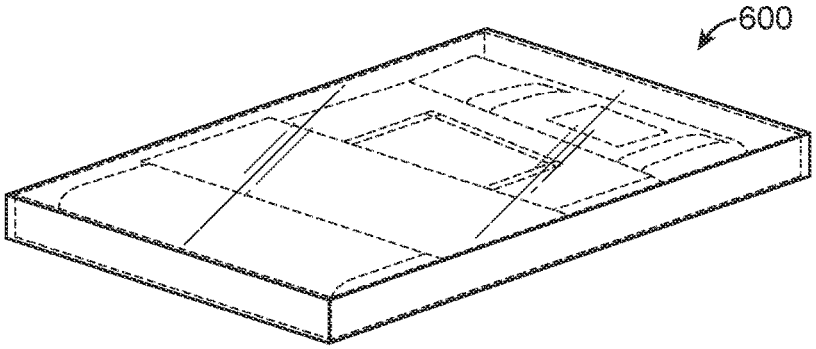
FIGS. 6A-6D show packaging for retaining a pair of pants to be personalized according to embodiments of the present technology.
Figure 6B:
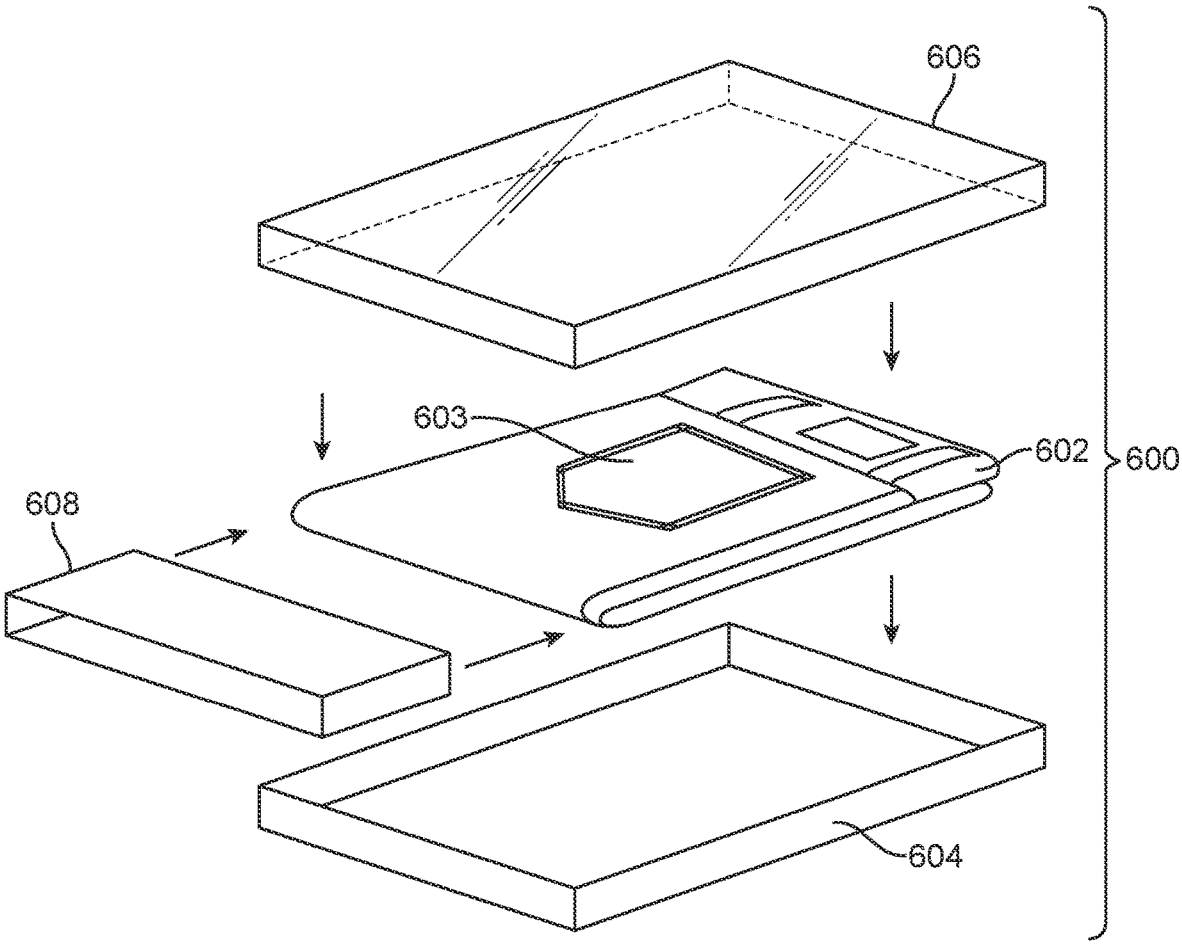
Figure 6C:
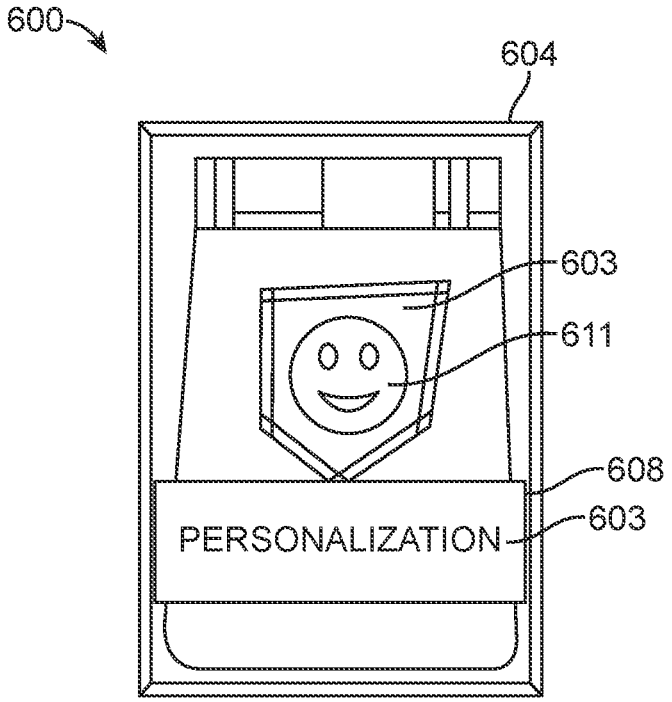
Figure 6D:
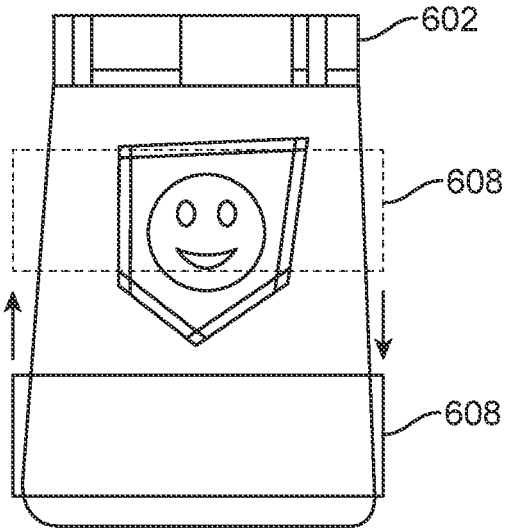

In some embodiments, the insert may surround a portion of an article in order to provide rigid structure to the article. For example as shown in FIGS. 6A-6D, the insert may be a band 608 sized and shaped to slide over a pair of folded pants. The article within the insert 608 may be positioned within an outer box 604. The insert 608 may have a width corresponding to the inner width of the outer box 604 so that movement of the article 602 is limited in the directions of the width and perpendicular to the width. The insert 608 may be variably positioned on the article 608 in order to selectively define the predetermined surface 603 of the article 602 to be personalized, for example as shown in FIG. 6D. Further, in some embodiments, the insert 608 may be positionable in different positions for transport, storage, personalization, and/or retail. In some embodiments, the insert may include surfaces 603 to be personalized by the same or different personalization systems personalizing the article, as shown in FIG. 6C. In some embodiments, the surface of the insert to be personalized may be substantially coplanar with the surfaces of the article to be personalized, for example as shown in FIG. 6C.

Figure 7A:
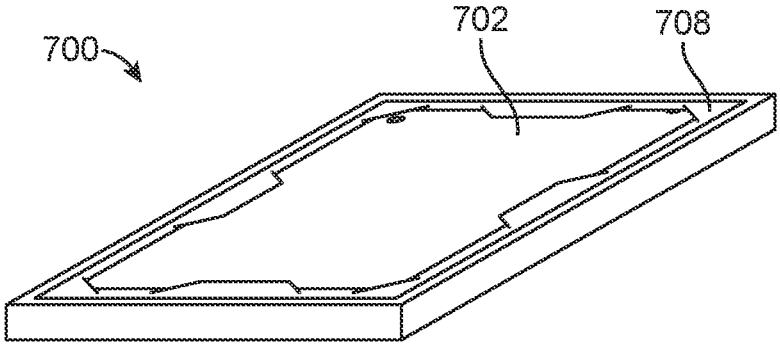
FIGS. 7A-7D show packaging for retaining a tablet to be personalized according to embodiments of the present technology.
Figure 7B:
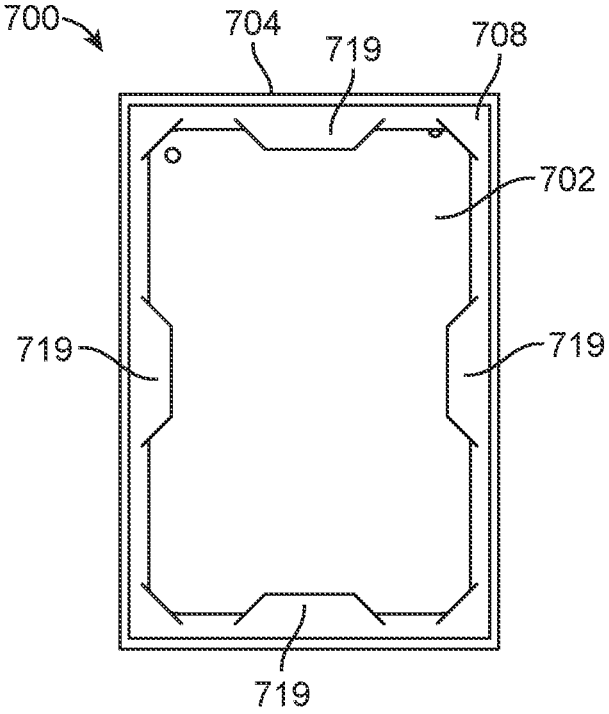
Figure 7C:
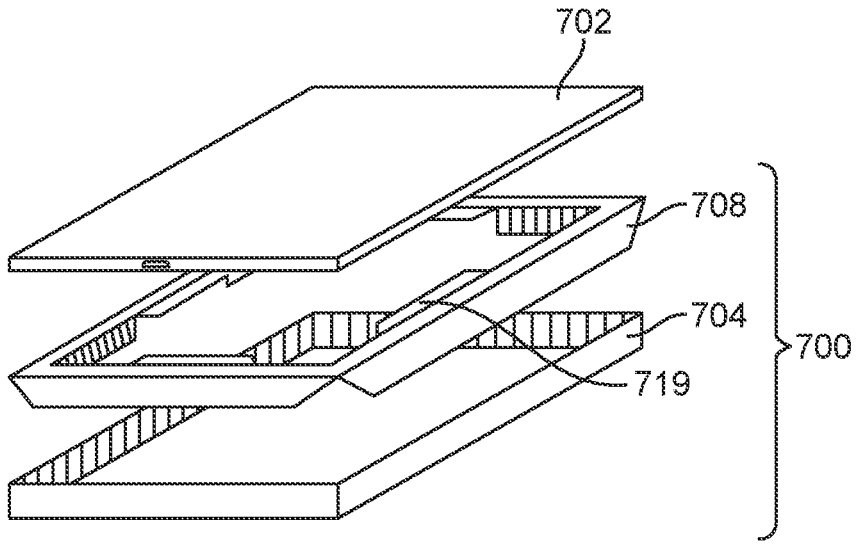
Figure 7D:
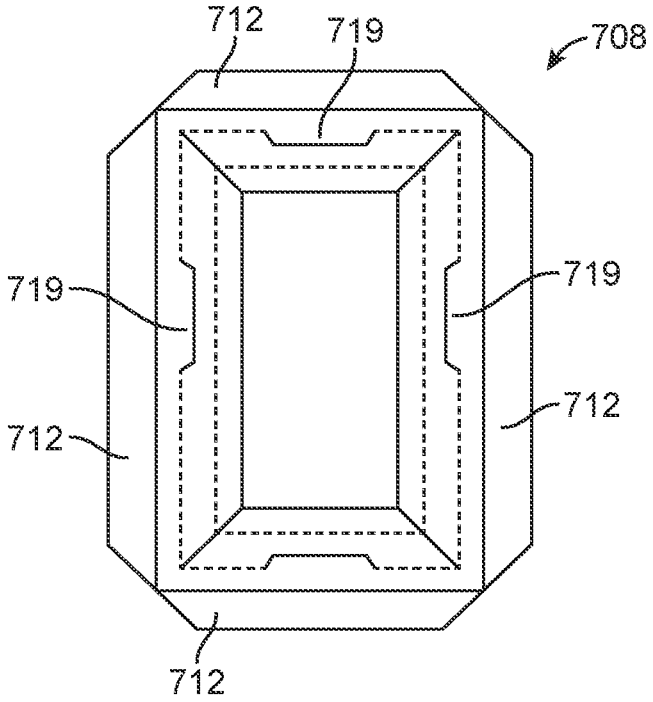

FIGS. 7A-7D and 8A-8I show embodiments of packaging for retaining an electronic tablet. In some embodiments, similar packaging may be used for retaining articles similar to tablets, including by not limited to, smartphones and laptops. As shown in FIGS. 7A and 7B, a packaging 700 may include a first container in the form of a rectangular outer box 704, and a rectangular insert 708. The insert 708 defines a rectangular recess for retaining a tablet 702. In some embodiments, for example as shown in FIGS. 7A and 7B, the insert 708 may include tabs 719 for contacting an area of the article around the predetermined surface to be personalized. The tabs 719 may retain the article 702 within the recess of the insert 708. As shown in FIG. 7D, an insert 708 with a recess, tabs, and a sidewall may be formed from a single sheet of material, for example cardboard, including cutouts and predefined creases for folding the sheet to define the insert. As noted above, in some embodiments, packaging may include a covering over the personalization opening. For example, the embodiments of packaging as shown in FIGS. 7A-7D and 8A-8I may include a flap or door for covering opening over the predetermined surface of the article, that may be opened/uncovered for personalization processes.

Figure 8A:
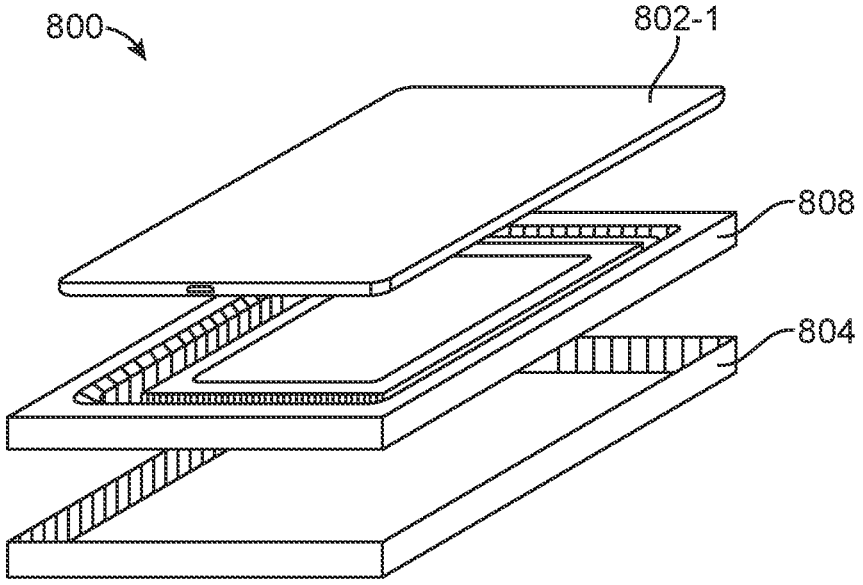
FIGS. 8A-8I show packaging for retaining different sized tablets to be personalized according to embodiments of the present technology.
Figure 8B:
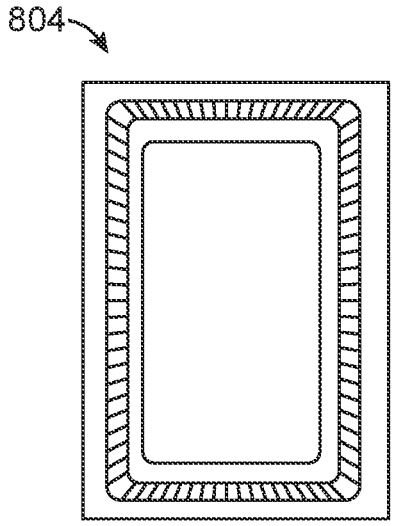
Figure 8C:
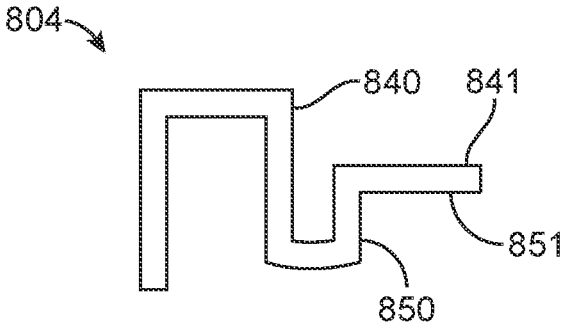
Figure 8D:
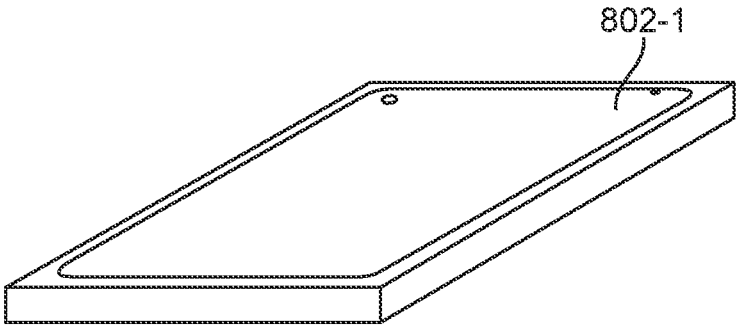
Figure 8E:
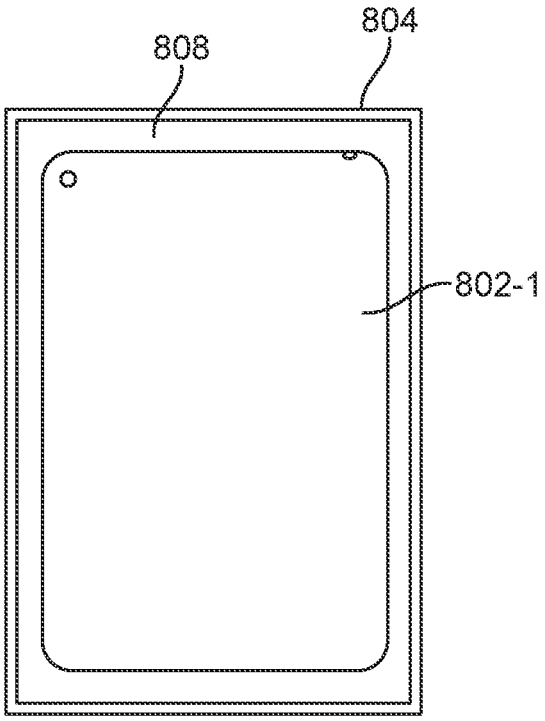
Figure 8F:
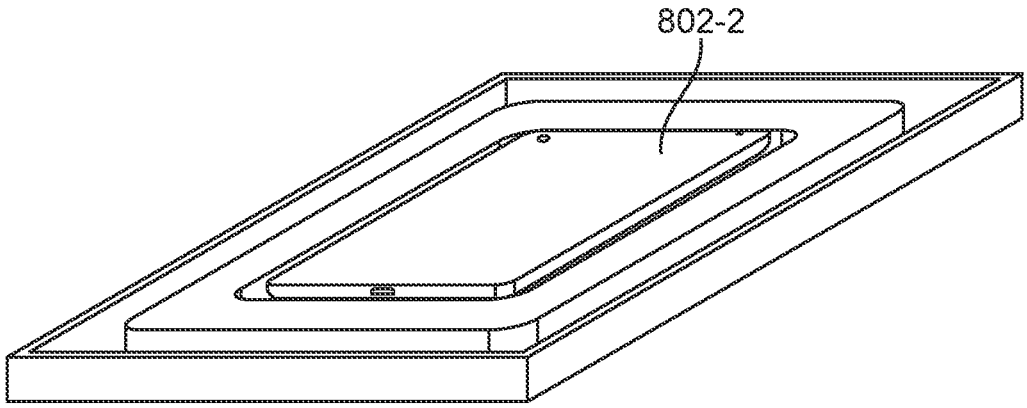
Figure 8G:
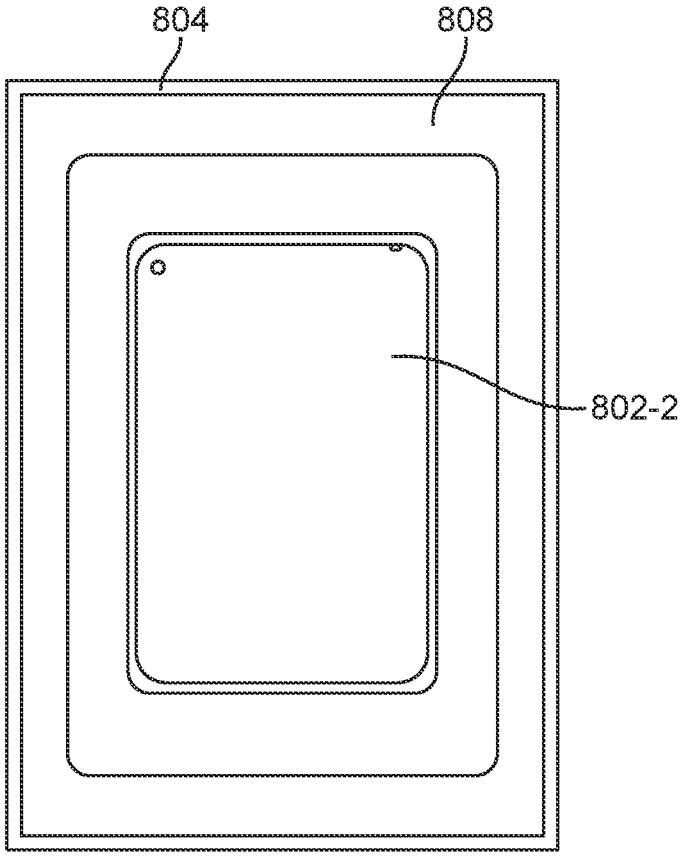
Figure 8H:
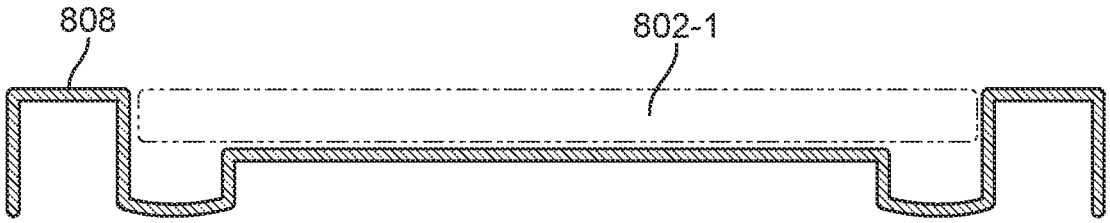
Figure 8I:
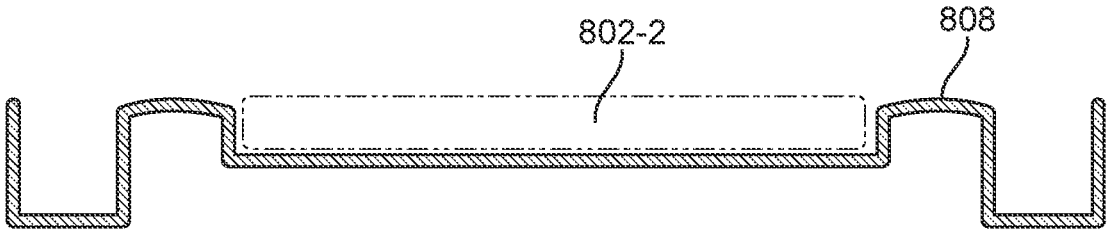

In some embodiments, an insert may include features for defining recesses for retaining articles of different size and/or shape. For example, as shown in FIGS. 8A-8I and insert 808 includes a first recess for retaining a first sized tablet 802-1, and a second recess for retaining a second sized tablet 802-2, smaller than the first sized tablet. Specifically, FIG. 8A shows packaging including an outer box 804, an insert 808 with a first side defining a first recess facing away from the outer box, and a first sized tablet 802-1. As shown in the top view of FIG. 8B and the sectional cross-sectional view of FIG. 8C, the first side of the insert defines the first recess including a first bottom surface 841 and a first side surface 840. Further, as shown in the sectional cross-sectional view of FIG. 8C, the second side of the insert defines a second recess including a second bottom surface 851 and a second side surface 850. As shown in FIGS. 8D, 8E and 8H, with the first side of the insert facing up and away from the outer box, the first sized tablet 802-1 may rest against the first bottom surface 841 and may be retained with a press fit between the first side surfaces 840. Similarly, as shown in FIGS. 8F, 8G and 8I, with the second side of the insert facing up and away from the outer box 804, the second sized tablet 802-2 may rest against the second bottom surface 851, and may be retained with a press fit between the second side surfaces 850.

The technology has now been described in detail for the purposes of clarity and understanding. However, those skilled in the art will appreciate that certain changes and modifications may be practiced within the scope of the appended claims.

What is claimed is:

1. A system for retaining a pair of eyeglasses to be personalized in a predetermined position relative to a packaging, comprising:

the pair of eyeglasses comprising a rigid lens frame, a first arm and a second arm; and the packaging comprising:

a first container defining an interior cavity;

an insert retaining the pair of eyeglasses in a predetermined position and orientation relative to the insert, wherein the insert is positioned within the interior cavity so that the pair of eyeglasses retained by the insert is within the interior cavity, wherein the insert defines a first opening through a top surface of the insert and receiving the first arm of the pair of eyeglasses, the insert defines a second opening through the top surface and receiving the second arm of the pair of eyeglasses, and the insert comprises a first resilient protrusion coupled to the top surface and exerting a first clamping force on a nose bridge of the rigid lens frame, a second resilient protrusion coupled to the top surface and supporting and exerting a second clamping force on a perimeter of the rigid lens frame, and a third resilient protrusion coupled to the top surface and supporting and exerting a third clamping force on the perimeter of the rigid lens frame in order to retain the pair of eyeglasses in the predetermined position, wherein the first container defines a third opening configured to provide access to a personalization system for personalizing a predetermined surface of the pair of eyeglasses while the pair of eyeglasses is retained by the insert in the predetermined position and the insert and pair of eyeglasses are positioned within the interior cavity so that the predetermined surface can be personalized based on the position of the first container relative to the personalization system.

2. The system of claim 1, wherein the personalization system is one of, an engraving system, a laser etching system, a robotic pen marking or a decal application system, and wherein the opening is configured to receive a personalization head of the personalization system.

3. The system of claim 1, wherein the first, second and third protrusions are composed of rubber.

4. The system of claim 1, wherein the predetermined surface is a surface of the arms of the pair of eyeglasses.

5. The system of claim 1, wherein the predetermined surface is a surface of the lens frame of the pair of eyeglasses.

* * * * *